United States Patent [19]

Snyder

[11] Patent Number: 4,576,093

[45] Date of Patent: Mar. 18, 1986

[54] REMOTE RADIO BLASTING

[76] Inventor: Richard N. Snyder, P.O. Box 295, Lorton, Va. 22079

[21] Appl. No.: 599,690

[22] Filed: Apr. 12, 1984

[51] Int. Cl.[4] ..... F42D 1/00

[52] U.S. Cl. ..... 102/200

[58] Field of Search ..... 102/200, 206, 215, 217–220, 102/221; 361/248

[56] References Cited

U.S. PATENT DOCUMENTS 2,411,788 11/1946 Hammond, Jr. ..... 102/206

3,086,465 4/1963 DeMontfort ..... 102/206

3,834,310 9/1974 Ueda et al. ..... 102/220

4,026,215 5/1977 Ziemba et al. ..... 102/206

*Primary Examiner*—Charles T. Jordan

*Attorney, Agent, or Firm*—Lane and Aitken

[57] ABSTRACT

The invention relates to a radio remote blasting system. The subject blasting system includes a portable remote controlled detonation system comprising a tone generating pad employed to generate a coded signal received at a blasting site by a receiver decoder detonator to enable detonation to occur by conventional means, also a radio telephone used to encode signal frequencies for use in enabling an explosive detonating device and allowing two way communication.

7 Claims, 4 Drawing Figures

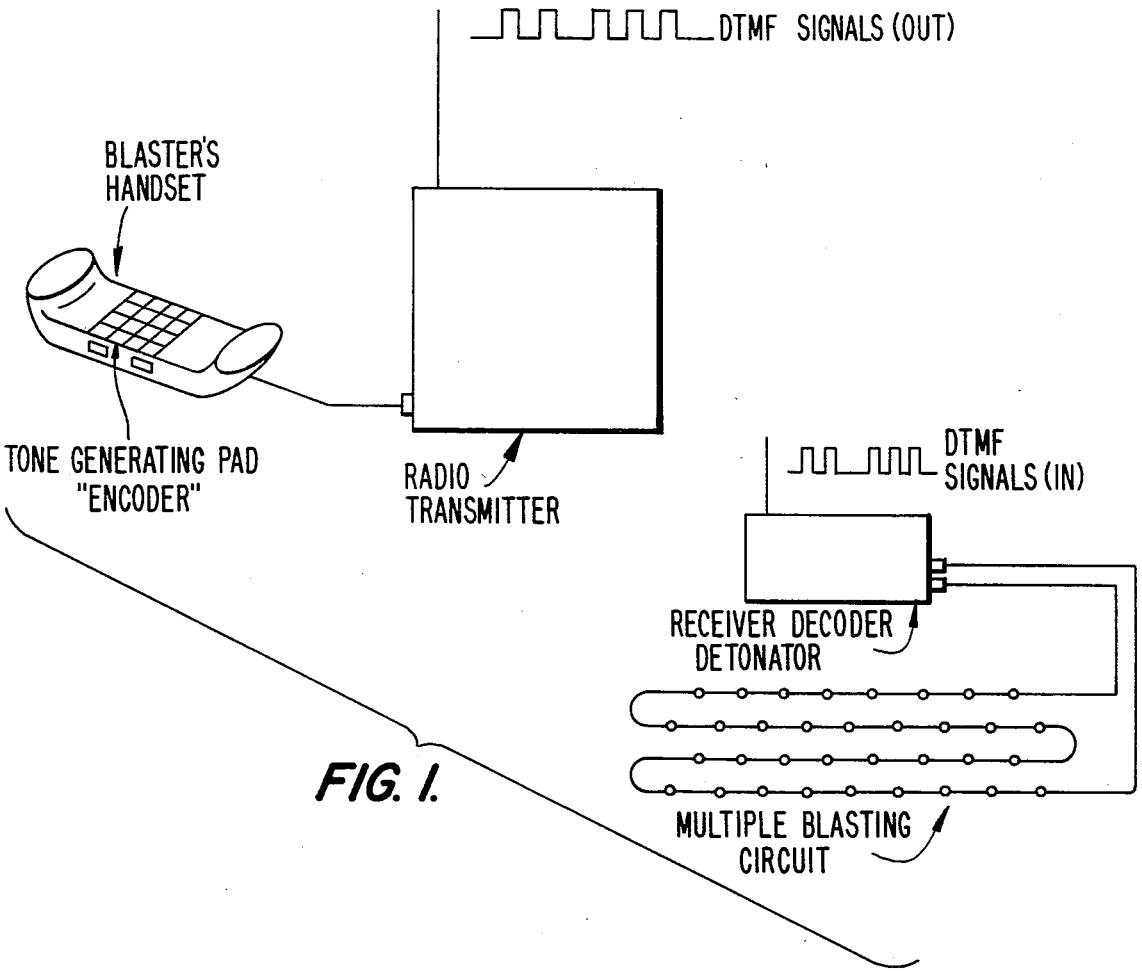
FIG. 1.
FIG. 2.
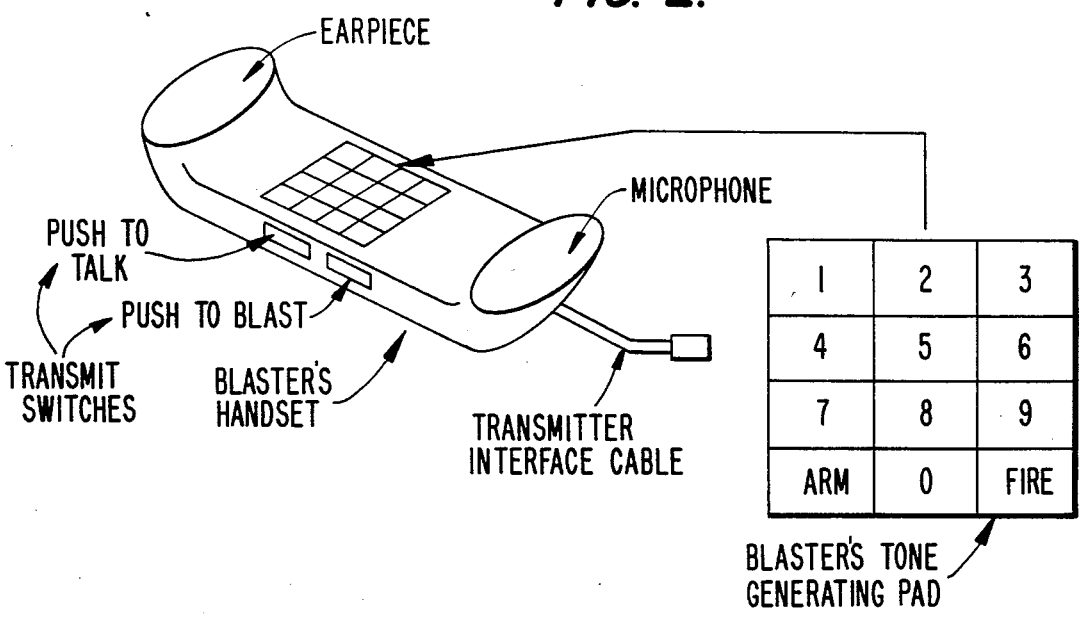

REMOTE RADIO BLASTING

BACKGROUND OF THE INVENTION

This invention relates to conventional blasting. More specifically, this invention relates to utilizing a radio remote blasting system to fire the electric blasting caps. In conducting such conventional blasting, several methods have been utilized. After drilling holes, placing charges and adding electric blasting caps, connecting wire is run a considerable distance from the blasting site to maintain safety. However, due to the many ways rock can be formed, with fissures and pressure and many other factors, the "fly rock" (small chips of a larger rock that have been propelled through the air due to the force of the explosion) can cause injury and equipment damage, even when large rubber mats are used to control the noise and contain the explosion.

The blaster's job is to use the correct type of explosive substance (slurries, gels, powders, etc.) as well as the correct amount of the type selected to achieve the various desired results (split, crack, shatter, reduce to pebble size stones, etc.). He must then decide, after the previous decisions are made, how many charges to place, how deep the holes must be, where and how many holes need to be drilled to achieve the final results. When this is accomplished, the wires (in series, series-parallel, or parallel) are strung from each of the blasting caps and the entire explosion area is covered with mats or dirt to contain the explosion. Then, after checking continuity of the line with a blaster's ohmeter or galvanometer, the line is connected to an electric blasting device (heretofore operated by the blaster) who then, using a siren or horn, blows a signal to "stand clear" and then pushes the switch, button or plunger, twists the handle or somehow initiates the electronic device that sends sufficient current through the wires to the caps to detonate the explosive. The subject invention is directly related to the blasting method such as previously described.

Another previously known method of blasting involves utilizing a remote control robot to carry the explosives to the blasting site, leave the explosive with a receiver attached and detonate the explosive from a distance using a remote control system as in many model airplane circuits, allowing possible premature detonation caused by random radio signals.

While such a system as previously noted has achieved at least a degree of industry recognition and utilization, room for significant improvement remains.

Several various designs have been advantageously utilized to detonate by a remote means. One such design for underground detonating involves seismic sensors and the use of seismic "waves" at various key frequencies to control the detonation. This method, as mentioned, is designed for long distance underground detonation, more specifically, nuclear explosions.

The difficulties suggested in the preceding are not intended to be exhaustive, but rather among which may tend to reduce the effectiveness of prior remote systems. Other noteworthy problems may exist; however, those presented above should be sufficient to demonstrate that blasting, conventional or remote, done in the past, will admit to worthwhile improvement.

OBJECTS OF THE INVENTION

It is, therefore, a general object of the invention to provide a novel remote tone generating pad operated blasting system which will obviate or minimize problems of the type previously described.

It is a particular object of the invention to provide a blasting system which is capable of initiating a blast from any distance utilizing a series of radio handsets.

It is yet another object of the invention to provide a novel portable remote controlled detonation system that the blaster's handset of said system is compatible with a military type back pack or mobile radio.

It is still another object of the invention to provide a transceiver that allows two way, long distance communication prior to setting off the blast.

It is a further object of the invention to provide a receiver decoder detonator that rejects all unwanted signals, making it nearly impossible to trigger the unit, causing premature detonation.

BRIEF SUMMARY OF A PREFERRED EMBODIMENT OF THE INVENTION

One preferred embodiment of the invention which is intended to accomplish at least some of the foregoing objects comprises a radio remote blasting system made up of a tone generating blaster's handset connected to a transmitter and a receiver decoder detonator blasting control connected to the blasting caps. The tone generating handset can be of the mobile or fixed radio transmitter type, comprising a tone generating pad, earpiece, microphone and interface cable. The handset is wired to a transmitter, and given a certain sequence of keys, activates the receiver decoder detonator allowing the sender to arm the detonator with yet another sequence. With the receiver decoder detonator armed and ready, another signal is generated from the handset which detonates the explosive charges.

In describing the invention the term conventional blasting has been used in particular relation to the type of electric blasting that is utilized by the majority of blasting crews. It is possible, however, to utilize this same system with other types of systems considered non electric and the like.

THE DRAWINGS

Other objects and advantages of the present invention will become apparent from the following detailed description of a preferred embodiment taken in conjunction with the accompanying drawings, wherein:

FIG. 1 is a plan view of the radio remote blasting system including the blaster's handset, radio transmitter, receiver decoder detonator and one of many possible blasting circuits appropriate to use with this system;

FIG. 2 is a plan view of the blaster's handset with a tone generating pad similar to those utilized on radio telephones.

DETAILED DESCRIPTION

Figure 3:
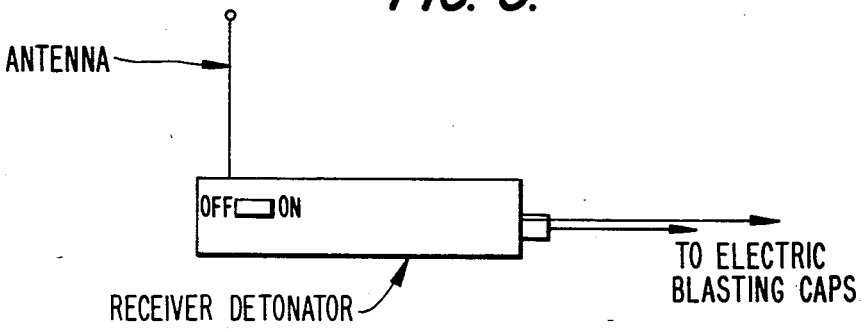
FIG. 3 is a plan view of the receiver decoder detonator including an antenna to receive signals, an on/off switch and binding posts to secure the wires to the electric blasting caps.
Figure 4:
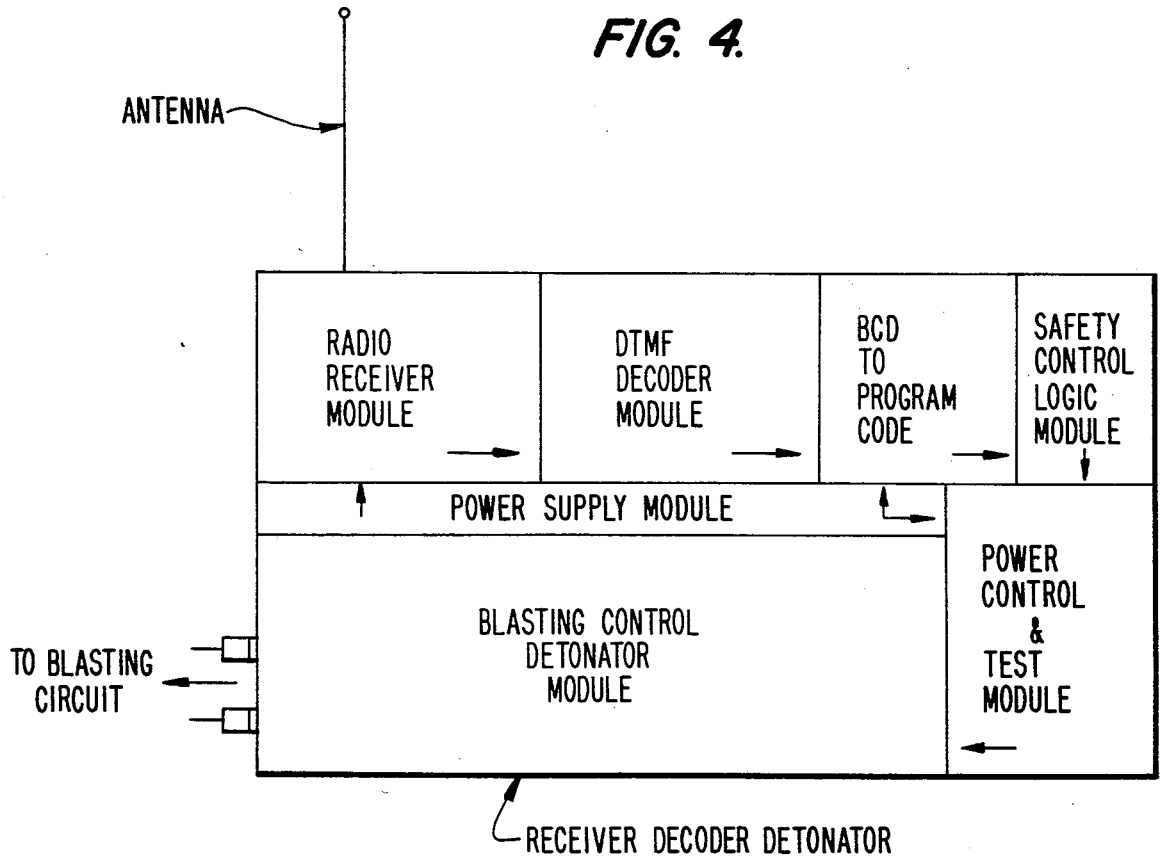
FIG. 4 is the logic diagram for the receiver decoder detonator.

Before presenting a detailed description of the subject invention, it may be worthwhile to briefly outline the context of the instant invention. In this connection, FIG. 1 depicts a radio transmitter similar to a military back pack or mobile radio transceiver which is utilized in the radio remote blasting system.

The radio remote blasting system's blaster's handset serves a dual function in that it provides DTMF (Dual Tone Multi-Frequency) frequency modulated coded tones for safe blasting, while the transmitter portion maintains a communication link between the blast area and the home base.

The coded transmission signal, when received at the receiver decoder detonator, is amplified in the radio receiver module. The DTMF decoder converts the audio tones through signal processing to noise free digital signals in binary codes. Only the desired binary codes are allowed to pass through the precoded gates of the BCD (Binary Coded Decimal) to program code module, enhancing the safety factor through extreme selective signal screening. These signals are then passed to the safety control logic module. The safety control logic module is another safety provision which controls the arming and firing operation. The firing is allowed only if the receiver decoder detonator is first placed in the armed mode. Once the receiver decoder detonator is placed in the armed mode it may be fired only if the correct firing codes are passed from the safety control logic module to the firing detonator unit.

The coding of the receiver decoder detonator may be preset at the origin of manufacture or in the field by manually preset internal switches. The precoding must be known by the blaster in order to carry out his operation since the blaster's tone generating pad is the initial step in the wireless coded operation. Any multiple set of codes may be used depending on the design of the radio remote blasting system's receiver decoder detonator unit.

Now, having discussed the inner functions of the radio remote blasting system, perhaps we should describe the blasting operators function.

METHOD OF OPERATING THE RADIO REMOTE BLASTING SYSTEM

The task originates in establishing the blast area, setting the charges, caps and wires in place, then running wires to the receiver decoder detonator's terminals. If the receiver decoder detonator has not been preset, set the internal switches to a coded sequence of numbers, such as the month and year of a birthdate, activate the receiver decoder detonator by turning the external switch "on" and then the blasting operator (carrying the blasters handset and transceiver) may, 1 to 5 minutes after the blasting operator has activated the receiver decoder detonator, detonate the charges. However, he may receive commands from yet another person via radio. This system is capable of detonation by as few as one person up to an unlimited number of involved individuals. The radio operator actuates the encoder by holding the transmit switch and the transmit tone switch continuously with one hand while, with the other hand, depressing the sequence of DTMF coded tones required to activate the receiver decoder detonator (in this instance, the month and year of the blaster's birthday). The receiver decoder detonator is now armed. The radio operator now has three options.

(1) Fire—While the transmit tone switch remains depressed, press the # key on the handset to fire the charges.

(2) Hold—The radio operator may release the switches and wait for a later time to detonate.

(3) Abort—While the transmit tone switch remains depressed, enter the abort code (Example: the reverse of the activate code sequence) the receiver decoder detonator returns to the ready status awaiting another command to arm.

Both option 2 and 3 have a maximum time element. If the command is not given in 10 minutes (for example) then the receiver decoder detonator will deactivate.

SUMMARY OF MAJOR ADVANTAGES OF THE INVENTION

After reading and understanding the foregoing description of the subject invention, in conjunction with the drawings, it will be appreciated that several advantages of the subject radio remote blasting system are obtained.

Without attempting to set forth all of the desirable features of the radio remote blasting system, at least some of the major advantages of the invention include the provision of a receiver decoder detonator which will receive coded signals from the blaster's handset and transmitter, decode the said signals and arm, fire or abort on the correct command, screening spurious radio noise which precludes misfiring.

Two way communication without accidental detonation is accomplished by the blaster's handset and transceiver. The tone generating pad sequences the precise coding system to make the completely wireless remote detonating system possible.

In describing the invention, reference has been made to a preferred embodiment and illustrative advantages of the invention. Those skilled in the arts, however, and familiar with the instant disclosure of the subject invention, may recognize additions, deletions, modifications, substitutions and/or changes which will fall within the purview of the subject invention and claims.

I claim:

1. A remote control detonation system comprising a radio transmitter operable to transmit a radio signal on a carrier, encoder means at said transmitter operable to generate encoded signals in sequence, means at said transmitter responsive to said coded signals to modulate said carrier in accordance with said encoded signals, a radio receiver operable to receive the carrier signal transmitted by said transmitter, a detonating circuit operable when activated to detonate an explosive, and decoding means connected to said receiver responsive to a predetermined sequence of encoded signals received by said receiver to activate said detonating circuit only when said predetermined sequence of encoded signals have been received by said receiver.

2. A remote control detonating system as recited in claim 1, wherein said means to generate encoded signals comprises a dual tone multiple frequency tone generating pad.

3. A remote control detonation system as recited in claim 1, wherein said encoder comprises a hand held handset connected to said radio transmitter, said tone generating pad being mounted on said handset.

4. A remote control detonating circuit as recited in claim 1, wherein said decoding means includes means to arm said detonating circuit in response to a predetermined sequence of encoded signals, and means to activate said detonating circuit only when said detonating circuit is armed in response to said receiver receiving a frequency signal from said transmitter.

5. A remote controlled detonation system comprising:

a blaster's handset including an encoder and;

a transmit switch located on said handset and;

a radio transceiver and;

a connector wire bundle for joining said encoder to said radio transceiver and;

a tone generating pad located on said handset and;

a connection means between said tone generating pad and said blaster's handset and;

a switch to selectively connect said tone generating pad to said connector wire through said blaster's handset.

6. A remote controlled detonation system as defined in claim 5 further comprising:

a receiver detonator for receiving encoded radio signals from said radio transceiver and activating a detonating circuit.

7. A remote controlled detonation system as defined in claims 5 or 6 wherein said receiver detonator further comprises:

a receiver module made up of integrated circuits and arranged in a logical sequence to provide signal reception of coded tones and rejection of unwanted signals or radio noise and;

a tone module made up of integrated circuits and arranged in a logical sequence to provide detection of and discrimination of coded tones and;

a converter module made up of integrated circuits and arranged in a logical sequence to convert binary data signals to decimal codes and;

a control module made up of integrated circuits and arranged in a logical sequence to provide safety options to the operator such as fire, wait, and abort and;

a test module made up of integrated circuits and arranged in a logical sequence to control a blasting device and to act as a means to test the preceeding logic circuits and;

a blasting module interfacing with the preceeding modules and providing output to detonate electric blasting caps, non electric systems, and the like and;

a battery operated power supply module providing portable instrument power and power to the preceeding modules.

* * * * *